US007648125B1

(12) United States Patent
Huang

(10) Patent No.: US 7,648,125 B1
(45) Date of Patent: Jan. 19, 2010

(54) WINCH CLUTCH ASSEMBLY

(76) Inventor: Shih Jyi Huang, No. 19, Alley 6 Lane 325, Chien Kang Road, Taipei (TW)

( * ) Notice: Subject to any disclaimer, the term of this patent is extended or adjusted under 35 U.S.C. 154(b) by 0 days.

(21) Appl. No.: 12/219,556

(22) Filed: Jul. 24, 2008

(51) Int. Cl.
*B66D 1/22* (2006.01)

(52) U.S. Cl. ..... 254/344; 254/346; 254/356; 475/275; 475/204; 475/298

(58) Field of Classification Search ..... 254/342, 254/344–347, 356, 362, 383; 475/204, 213, 475/249, 275, 276, 298
See application file for complete search history.

(56) References Cited

U.S. PATENT DOCUMENTS 4,161,126 A * 7/1979 Winzeler ..... 475/83
4,663,128 A * 5/1987 Helgeland ..... 117/201
6,431,289 B1 * 8/2002 Potter et al. ..... 173/47
6,572,506 B2 * 6/2003 Williams et al. ..... 475/204
7,448,597 B2 * 11/2008 Jacobson et al. ..... 254/274

* cited by examiner

*Primary Examiner*—Emmanuel M Marcelo
(74) *Attorney, Agent, or Firm*—Bacon & Thomas, PLLC

(57) ABSTRACT

The present invention is a winch clutch assembly, where the deceleration mechanism of the winch contains an additional second internal gear ring, and its outer annular wall is provided with multiple equally distanced fitting indents. The clutch assembly, external to the deceleration mechanism, has clutch levers shifted in longitudinal motion, where the clutch levers are used either to immobilize in the fitting indents of the second internal gear ring of the deceleration mechanism or to release from their immobilized state, enabling the power to transmit or pause to the steel rope sheave of the winch, to accomplish the clutch function.

11 Claims, 8 Drawing Sheets

WINCH CLUTCH ASSEMBLY

BACKGROUND OF THE INVENTION

1. Field of the Invention

The present invention relates to winch clutch assemblies, more particularly, to a deceleration mechanism of the winch which contains an additional second internal gear ring, where its outer annular wall is provided with multiple equally distanced fitting indents, and the clutch assembly, external to the deceleration mechanism, has clutch levers shifted in longitudinal motion, where the clutch levers are used either to immobilize in the fitting indents of the second internal gear ring of the deceleration mechanism or to release from their immobilized state, enabling the power to transmit or pause to the steel rope sheave of the winch, to accomplish the clutch function.

2. Description of the Prior Art

A winch is a lifting appliance capable of winding the sling in or out for the purposes of the lift-up or lay-down of the weight, also named as lifting winch. The spots for installing the winch are such as a high rise for lifting goods vertically in an ascending or descending manner, a jeep or a cross-country vehicle for towing away another vehicle for escaping from danger or for the emergency use by the rescuers. The winch makes use of winding the steel rope in or out to heave the weight or load, so that the power of the winch is designed to operate in driving the steel rope sheave into rotation or reverse rotation, and further to control the release or collection of the steel rope (named power letting off or piling up rope). Since the winch is designed for the collection or release of the steel rope by power, it is limited by the gradual transmission of power internally, which means the speed of collection or release keeps a moderate speed; therefore, for the emergency use (for instance rescuing someone in danger), the release of the rope by power frequently fails to meet the expectation, which indeed worries the rescuers very much. In order to improve the aforesaid drawback, the prior art winches are provided with clutch assembly. Once the clutch is put on "separate" state, the power, transmitted to the steel rope sheave, is being paused, which frees the winding of the steel rope sheave from being restricted by the power, for the release of the rope promptly by labor (named manually releasing the steel rope), and for one more step earlier in seizing the sufferers to be rescued or the objects to be lifted; then followed by returning to "joined" state, resuming the power to the steel rope sheave to achieve the lifting of the weight or the load. Prior art winch clutch assemblies are made up of quite many complex components, which bring about some drawbacks: complicating the procedure for the assembly, putting off the production, and raising the cost; there is a vague difference between the separate state and the joined state for their actions, which quite annoys the operator. By realizing the aforesaid defects, the inventor conceived the ideal of innovation and improvement, which gives birth to the present invention.

SUMMARY OF THE INVENTION

An object of the present invention is to provide a winch clutch which features novelty in the structural combination and is totally different from the prior art products.

Another object of the present invention is to provide a winch clutch which is characterized by unequivocal motions for the separate state and the joined state during their operations.

A further object of the present invention is to provide a winch clutch which is simple in structure and easy in assembly and operation.

To achieve the aforesaid objects, the winch clutch of the present invention comprises a motor, a deceleration mechanism, a clutch assembly and a steel rope sheave, where the steel rope sheave is built up in a sheave rack, and the motor is fixed at a first rack side and is located at one end of the sheave rack, while the deceleration mechanism is fixed at a second rack side and is located at the other end of the sheave rack, followed by the setup of the clutch assembly which is external to the deceleration mechanism; the deceleration mechanism fastens a shell at the outside of the second rack side, and the shell together with the second rack side accommodate a first internal gear ring, a second internal gear ring and a third internal gear ring in their common inside. The first internal gear ring is directly shaped on the inner wall of the shell near the outside, and a catch trough is devised next to the first internal gear ring, for accommodating the second internal gear ring shaped already somewhere, where the second internal gear ring is provided with multiple equally distanced fitting indents at its outer annular wall facing the first internal gear ring; the third internal gear ring with a larger diameter is directly formed next to the catch trough; a first planet gear, fitted in the first internal gear ring by a teeth clench, accommodates a gear driven by the motor to penetrate through its center and also by a teeth clench, where a gear at the other end contributes to the power; a second planet gear, fitted in the second internal gear ring by a teeth clench, accommodates the gear of the first planet gear to insert into its center and also by a teeth clench, where a gear at the other side contributes to the power; a third planet gear, fitted in the third internal gear ring by a teeth clench, accommodates the gear of the second planet gear to insert into its center and also by a teeth clench, where a gear at the other side contributes to the power; the shell has a fitting hole at the rim opposite to the second rack side, which joins the catch trough and relates to the fitting indents; the clutch assembly comprises a cover, a guide disk, a clutch disk, a springy body, a rotation body and a fitting disk, where the cover puts on the shell followed by a joint, and extends outward to form a protrusion; the guide disk has a hollow at its center to lodge the protrusion of the cover, is provided with push bulges located at its rim, and has guide objects located at its side opposite to the cover; the clutch disk has a hollow at its center to lodge the protrusion of the cover, is provided with clutch levers and position bulges on the side facing the guide disk, and is provided with arced troughs corresponding to the guide objects, where the clutch levers penetrate the cover and the fitting holes of the shell, and lodge in the fitting indents of the second internal gear ring, while the position bulges are in touch with the guide objects of the guide disk; the springy body caps the protrusion outside of the clutch disk; the rotation body forms a through hole at its center, forms a cover shell facing to the clutch disk, to cover and press the springy body, and further forms an association for the clutch disk, the guide disk and the cover; the rotation body has push rods formed inside the cover shell, which is able to clamp the corresponding push bulge; the fitting disk is located at the through hole of the rotation body, and fastened with the front of the protrusion of the cover.

In the aforesaid winch clutch assembly, the number of the fitting holes of the shell is adequate to be three.

In the aforesaid winch clutch assembly, the adequate number of the push bulges at the rim of the guide disk is three.

In the aforesaid winch clutch assembly, the adequate number of the guide objects distributed on the guide disk is three.

In the aforesaid winch clutch assembly, the guide objects have their lowest spots each to set up a low indented trough.

In the aforesaid winch clutch assembly, the guide objects have their highest spot each to set up a high indented trough.

In the aforesaid winch clutch assembly, the adequate number of the clutch levers of the clutch disk is three.

In the aforesaid winch clutch assembly, the adequate number of the position bulges on the clutch disk is three.

In the aforesaid winch clutch assembly, the adequate number of the arced troughs on the clutch disk is three, and each is in between the two position bulges.

DETAILED DESCRIPTION OF THE INVENTION

To achieve the aforesaid objects of the present invention, the technique adopted and the function achieved are detailed described with reference to the following preferred embodiments and the accompanying drawings, which would give a thorough comprehension on the present invention.

Figure 1:
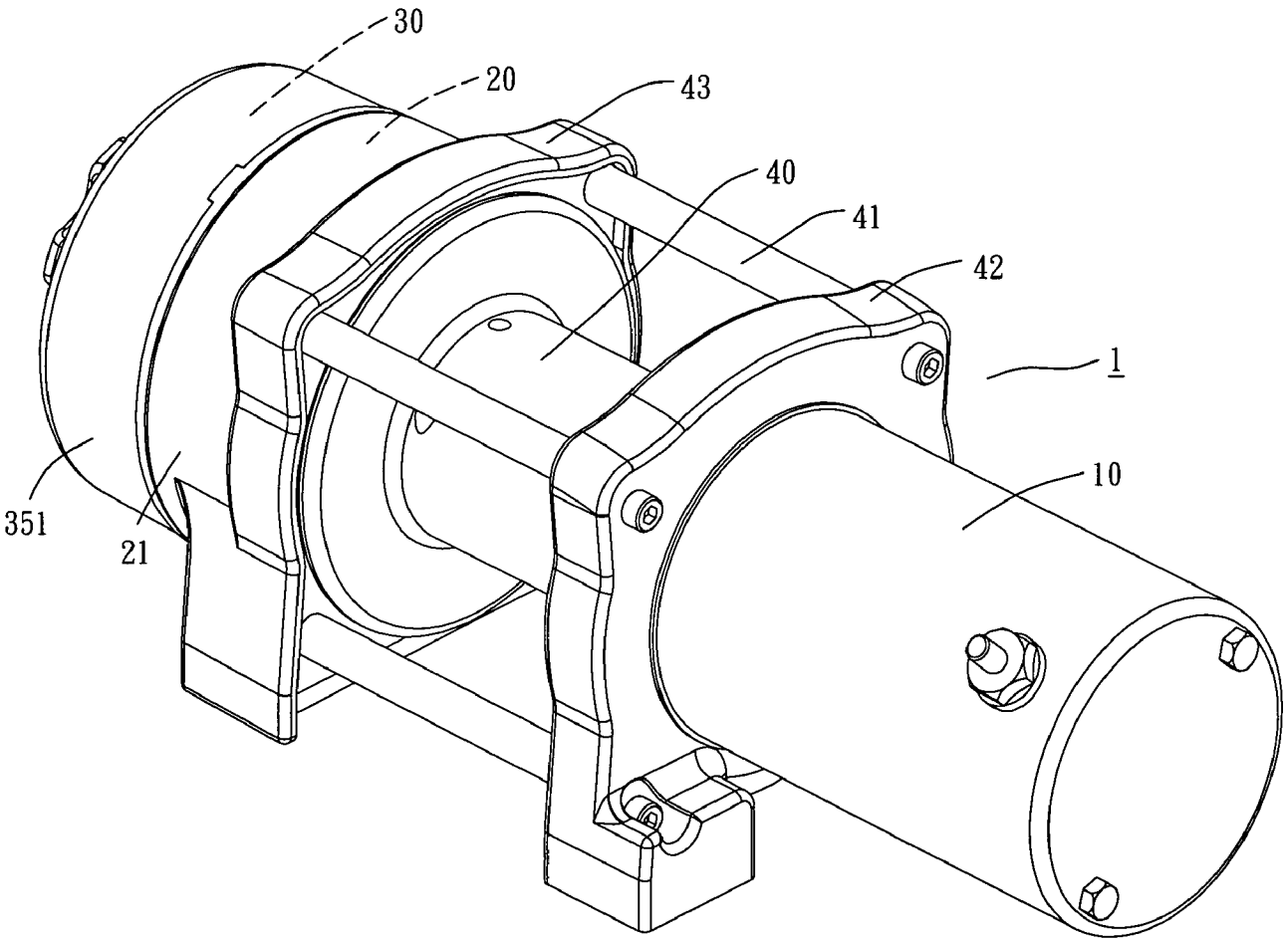
FIG. 1 is a three-dimensional external view exhibiting the winch of the exemplified embodiment of the present invention.

The exemplified embodiment of the present invention is a winch 1, referring to FIG. 1, which comprises a motor 10, a deceleration mechanism 20, a clutch assembly 30, and a steel rope sheave 40. The steel rope sheave 40 is built up in a sheave rack 41, and is able to rotate, while the sheave rack 41 is immobilized; the motor 10 is fixed at a first rack side 42 and is located at one end of the sheave rack 41, while the deceleration mechanism 20 is fixed at a second rack side 43 and is located at the other end of the sheave rack 41, followed by the setup of the clutch assembly 30 at the external to the deceleration mechanism 20. The function of the winch 1 begins by the rotation of the motor 10 to drive the axis (not shown) and then by the reduction of the speed stepwise in the deceleration mechanism 20, to drive the steel rope sheave 40 to rotate, where the steel rope sheave 40 has windings of steel rope around it (not shown), and the steel rope is being winding in or out, subject to the rotation of the steel rope sheave 40; the activation of the deceleration mechanism 20 enables the user to operate the clutch assembly 30 into the "separate" state or "joined" state; during the operation of the "separate" state, the power transmission in the deceleration mechanism 20 is being paused, disabling the power transmitted to the steel rope sheave 40, which makes the labor power to promptly pull out the rope from the steel rope sheave 40 to achieve the manual release of the rope; as the clutch assembly 30 is operated back to the "joined" state, the power transmission in the deceleration mechanism 20 is being resumed again, which enables the power transmitted to the steel rope sheave 40 to collect the rope. The novel features of the present invention lie in the combination of the components of the deceleration mechanism 20 and the clutch assembly 30 and the combinational features.

Figure 2:
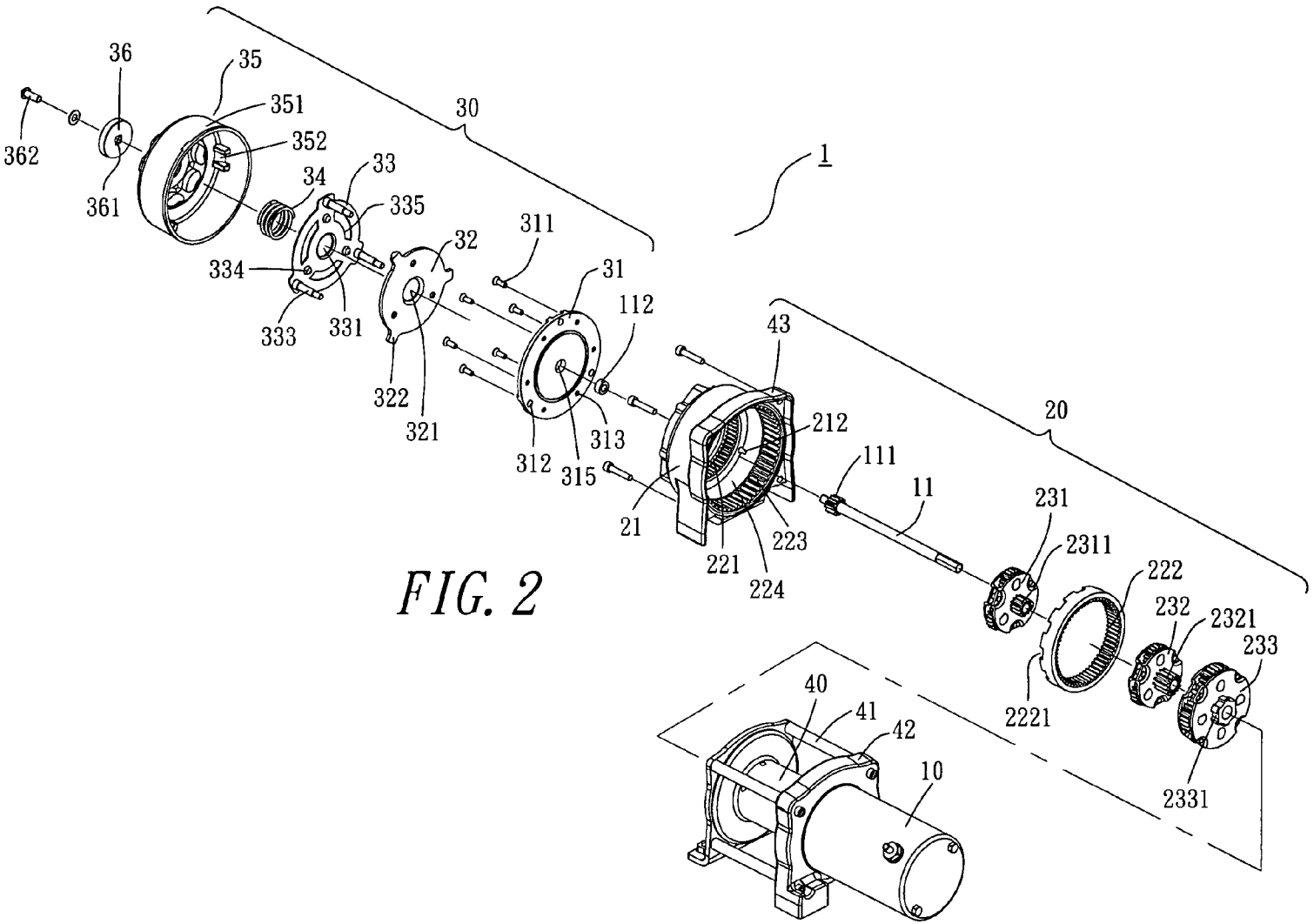
FIG. 2 is a three-dimensional exploded view exhibiting the deceleration mechanism and the clutch assembly of the exemplified embodiment of the present invention.
Figure 3:
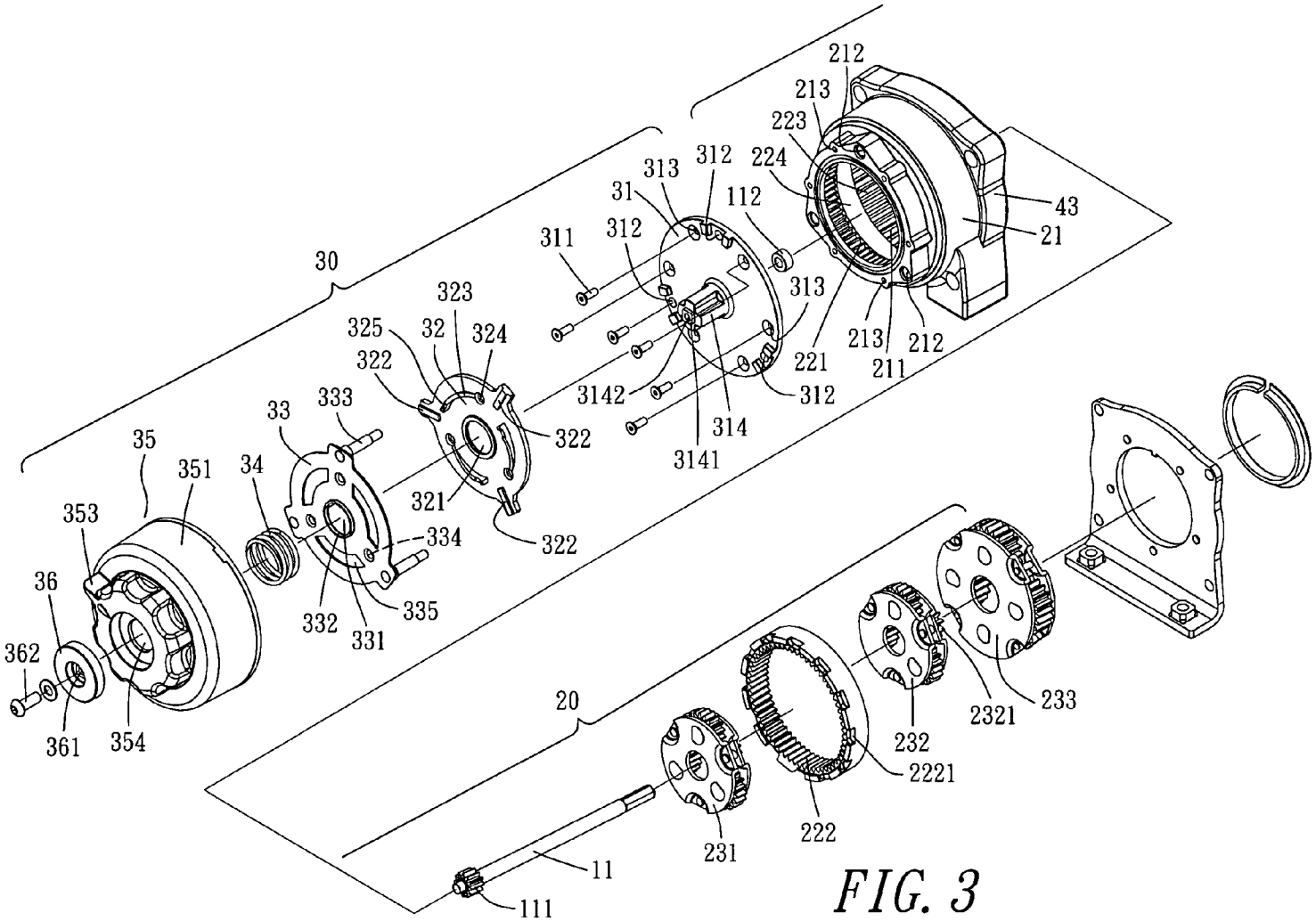
FIG. 3 is a three-dimensional exploded view exhibiting the deceleration mechanism and the clutch assembly of the exemplified embodiment of the present invention, where it is viewed from the opposite side to the FIG. 2.
Figure 4:
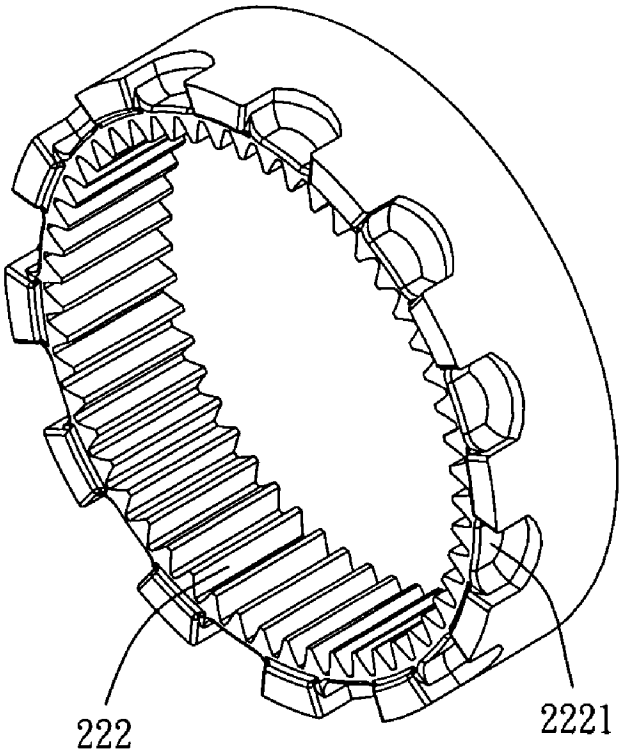
FIG. 4 is a three-dimensional external view exhibiting the second internal gear ring of the exemplified embodiment of the present invention.
Figure 12:
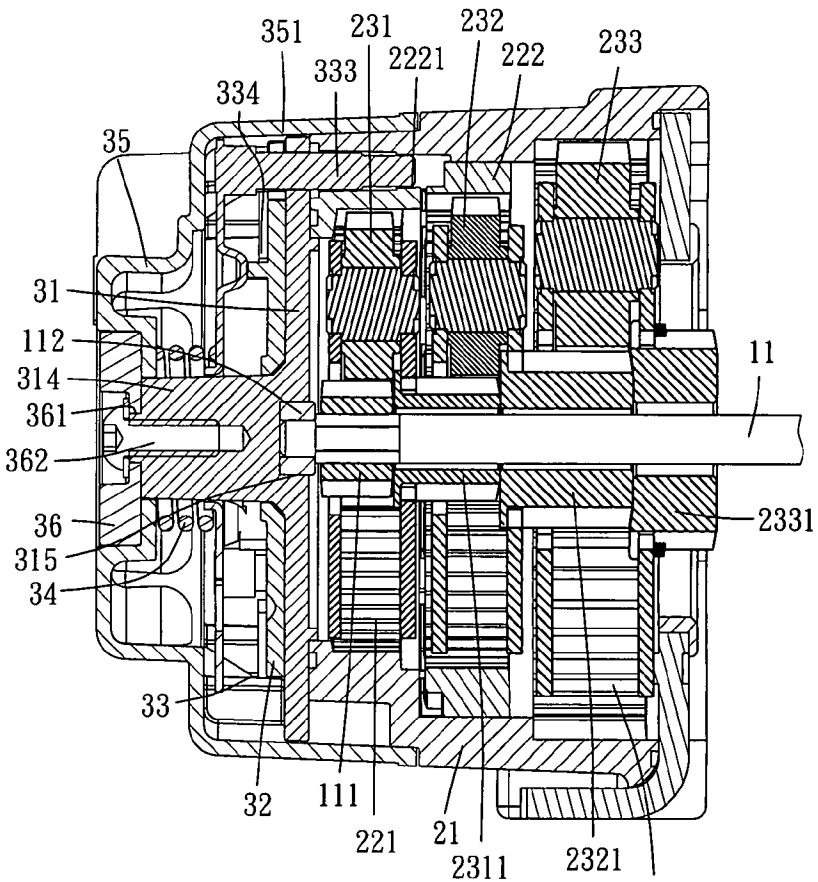
FIG. 12 a schematic diagram of the function of the clutch lever and the fitting indents of the second internal gear ring in the "separate" state operated by the exemplified embodiment of the present invention.
Figure 9:
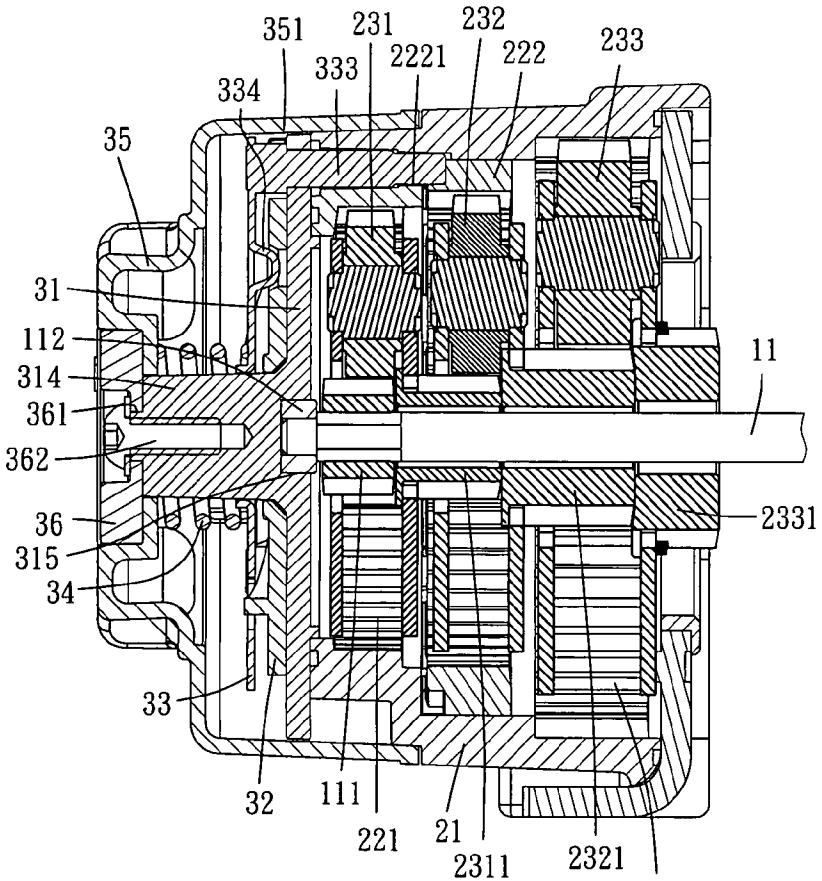
FIG. 9 is a schematic diagram of the function of the clutch lever and the fitting indents of the second internal gear ring in the "joined" state operated by the exemplified embodiment of the present invention.

Referring to FIGS. 2 & 3, the deceleration mechanism 20 has its outer part of the second rack side 43 fixed to the shell 21, and the shell 21 together with the second rack side 43 accommodate a first internal gear ring 221, a second internal gear ring 222 and a third internal gear ring 223 in their common inside. Referring to FIGS. 9 & 12, the first internal gear ring 221 is small in diameter and is directly shaped at the inner wall of the shell 21 near the outside; and a catch trough 224 is devised next to the first internal gear ring 221, for accommodating the second internal gear ring 222 formed already somewhere (shown in FIG. 4), where the second internal gear ring 222 is provided with multiple (for instance: 12 pieces) equally distanced fitting indents 2221 at its outer annular wall facing the first internal gear ring; the third internal gear ring 223 with a larger diameter is directly formed next to the catch trough 224; during assembly, a first planet gear 231 is fitted in the first internal gear ring 221 by a teeth clench, where a gear 2311 at the other side contributes to the power; a second planet gear 232, fitted in the second internal gear ring 222 by a teeth clench, accommodates the gear 2311 to insert into its center and also by a teeth clench, where a gear 2321 at the other side contributes to the power; a third planet gear 233, fitted in the third internal gear ring 223 by a teeth clench, accommodates the gear 2321 to insert into its center and also by a teeth clench, where a gear 2331 at the other side contributes to the power; as the above components are already installed in the common inside of the shell 21 and the second rack side 43, followed by the fixing of the second rack side 43 and the sheave rack 41, and the second internal gear ring 222 is bound firmly by the catch trough 224 and the third internal gear ring 223; the shell 21 has a hollow 211 at its side opposite to the second rack side 43 (shown in FIG. 3), and is provided with several fitting holes 212 and assembly holes 213 (for instance: screw hole) at its edge, where the fitting hole 212 extends inward to the catch trough 224, and relates to the corresponding fitting indents 2221, which has an adequate number of three.

The clutch assembly 30 comprises a cover 31, a guide disk 32, a clutch disk 33, a springy body 34, a rotation body 35 and a fitting disk 36, where the cover 31 is provided with through holes 312 (three is an adequate number) and assembly holes 313 on its rim corresponding to the fitting holes 212 and the assembly holes 213, once the cover 31 puts on the hollow 211 of the shell 21, the assembly articles 311 (for instance: screw bolt) is used to penetrate the assembly holes 313 and lodge in the assembly holes 213; the center of the cover 31 extends outward to form a protrusion 314 with a cross shape for its cross-section, and it forms a small bulge 3141 at its front and a assembly hole 3142 at its center, and the cover 31 has a lodging hole 315 at the center of its back side; a drive rod 11 driven by the motor 10 penetrates the first rack side 42, the steel rope sheave 40, the gear 2331, the gear 2311, and employs its drive gear 111 to insert into the center of the first planet gear followed by a teeth clench, where its terminal is lodged in the bearing 112 accommodated in the lodging hole 315. In this way, the motor power is transmitted to the first planet gear 231, through the drive rod 11 and the drive gear 111, to make the gear 231 rotate and the gear 2311 acts as the first part slow-down; the gear 2311 is used to drive the second planet gear 232 to rotate (subject to the immobility of the second internal ring 222) and the gear 2321 acts as the second part slow-down; lastly, the gear 2321 is used to drive the third planet gear 233 to rotate and the gear 2331 acts as the third part slow-down; the gear 2331 is then used to drive the steel rope sheave 40 by a teeth clench, which achieves the collection and release of the steel rope by the power.

Figure 5:
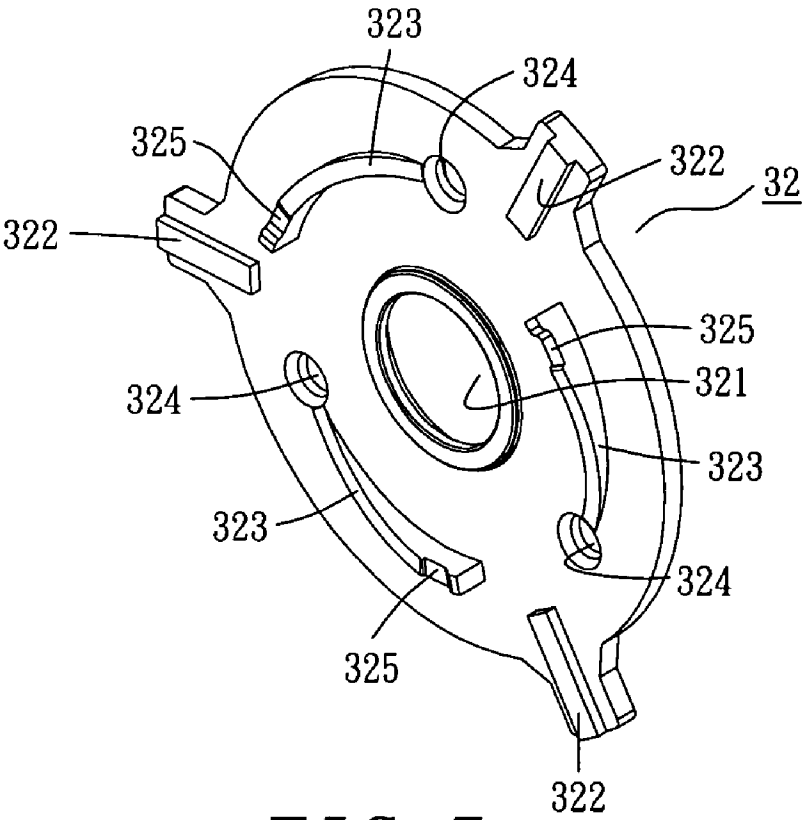
FIG. 5 is a three-dimensional external view exhibiting the guide disk of the exemplified embodiment of the present invention.
Figure 6:
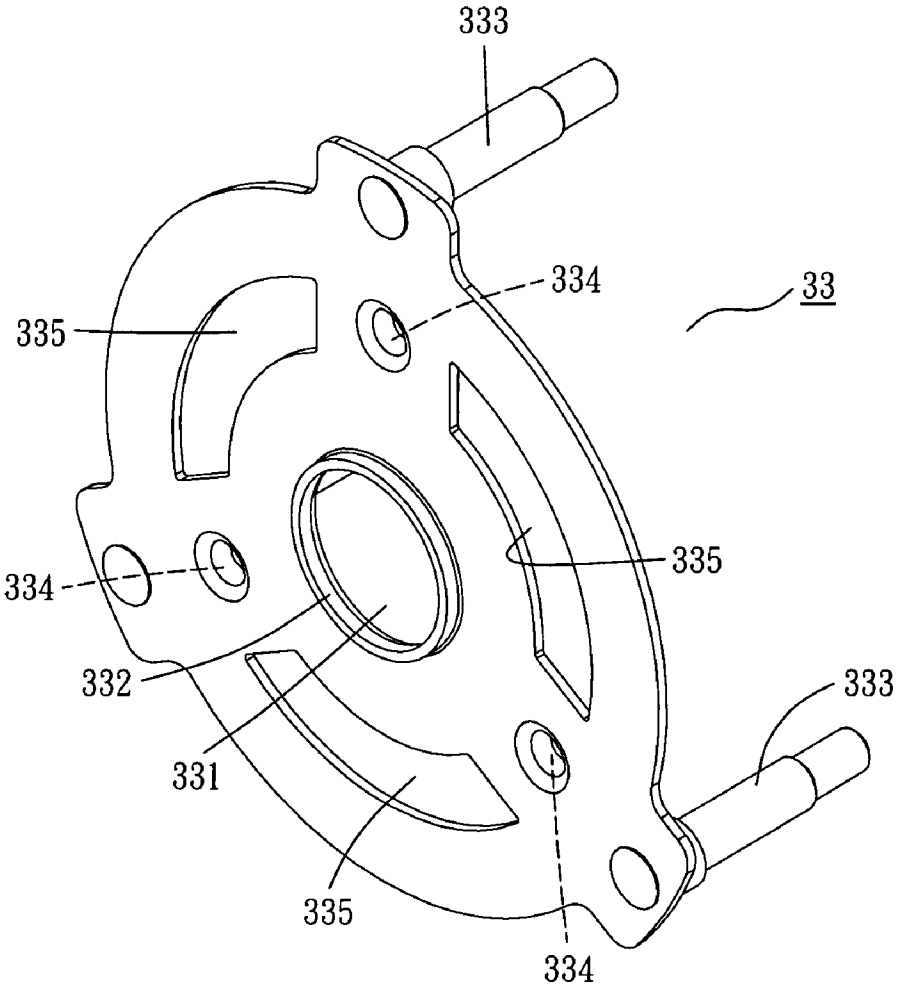
FIG. 6 is a three-dimensional external view exhibiting the clutch disk of the exemplified embodiment of the present invention.

Referring to FIG. 5, the guide disk 32 has a hollow 321 at its center, is provided with several (for instance: three pieces) push bulges 322 along its rim, and is provided with several (for instance: three pieces) guide objects 323 at the side opposite to the cover 31, where the lowest spot is set up a low indented trough 324 while the highest spot is set up a high indented trough 325, and the guide disk 32 encircles the protrusion 314 of the cover 31 with its hollow 321, where the farthest part of the rim will not exceed the scope of the holes 312, 313;

Referring to FIG. 6, the clutch disk 33 has a hollow 331 at its center, where the hollow 331 has an annular wall 332 along its rim, and the farthest rim of the clutch disk 33 has to be wider than the guide disk 32. The clutch has several (for instance: three pieces) clutch lever 333 to extend toward the guide disk 32, and is provided with several (for instance: three pieces) position bulges 334, where an arced trough 335 corresponding to the guide object 323 is set up in between two consecutive position bulges 334. In the assembly, the clutch disk 33 has its hollow 331 to encircle the protrusion 314 of the cover 31, and the clutch levers 333 are used to penetrate the corresponding through holes 312 of the cover 31 and the fitting holes 212 of the shell 21 and lodge in the fitting indents 2221 of the second internal gear ring 222 (shown in FIGS. 9 & 12); the position bulges 334 are joining closely the low indented trough 324 of the guide disk 32; a springy body 34 caps the protrusion 314 by the side of the clutch disk 33, and also caps the annular wall 332 of the clutch disk 33;

The rotation body 35 forms a cover shell 351 at the side facing the clutch disk 33, shapes several push rods 352 (for instance: three pieces) at its internal, and shapes an indicator 353 at the side opposite to the clutch disk 33 and forms a through hole 354 at its center; the fitting disk 36 is a disk that fits in the through hole 354, and is provided with a square hole 361 at its surface which corresponds to the small bulge 3141 of the cover 31; during the assembly, the rotation body 35 is used to enclose and press the springy body 34, and the push rods 352 are used to clamp the corresponding push bulge 322, followed by placing the fitting disk 36 at the through hole 354, where its square hole 361 caps the small bulge 3141, and the assembly article 362 and the assembly hole 3142 are taken to engage a screwed connection; the press to the springy body 34 will also extend to the clutch disk 33, the guide disk 32 and the cover 31, which makes the three tie together closely.

Figure 8:
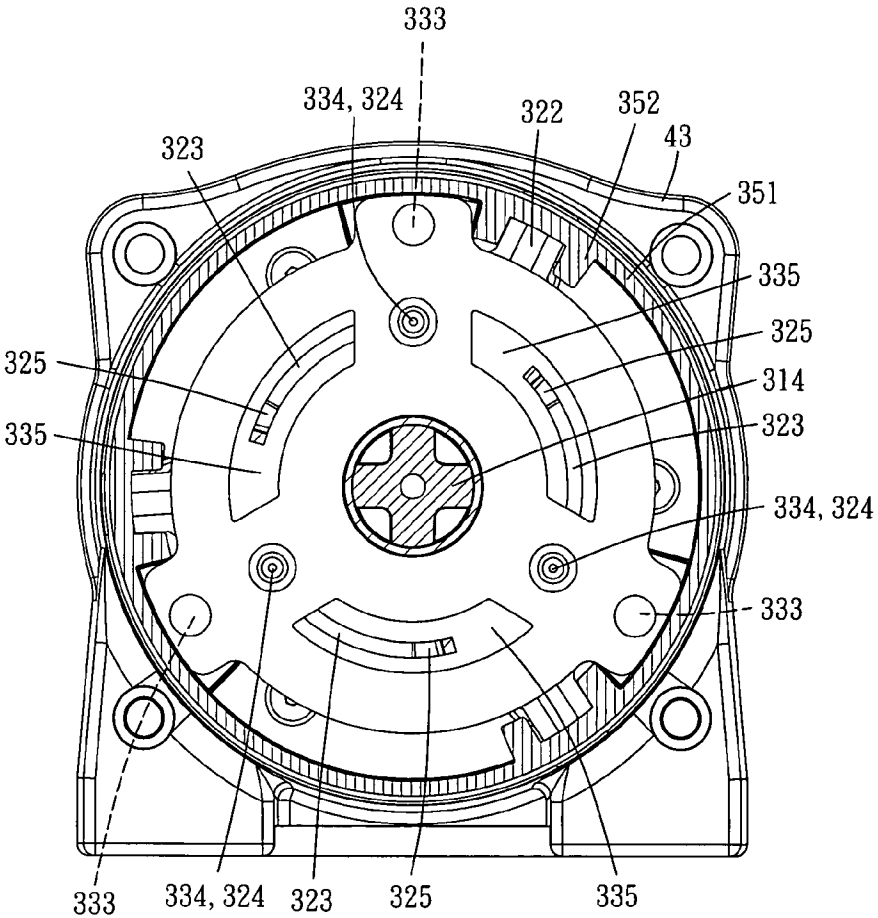
FIG. 8 is a schematic diagram of the function of the clutch disk and guide disk in the "joined" state operated by the exemplified embodiment of the present invention.
Figure 7:
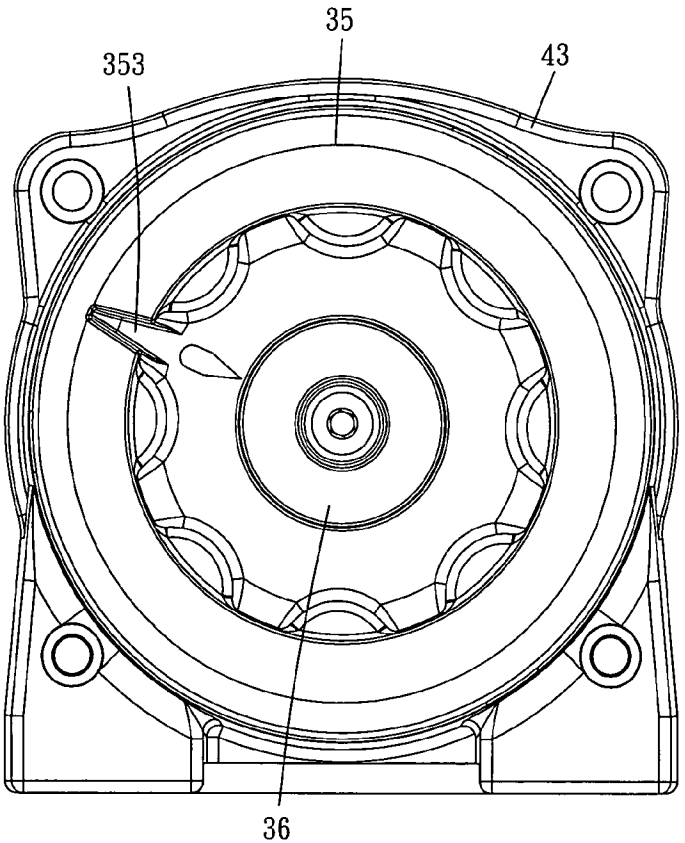
FIG. 7 is a schematic diagram of the indicator of the "joined" state operated by the exemplified embodiment of the present invention.

As the above assembly of the winch 1 is accomplished, rotating the rotation body 35 a small angle in either direction manually (the direction of rotation can be identified by the indicator) can select a motion of either inserting into or withdrawing from the fitting indents 2221 for the clutch levers 333. Referring to FIGS. 7-9, as the rotation body 35 rotates counterclockwise (according to the direction in FIG. 7), since the push rods 352 clamp the corresponding push bulge 322 of the guide disk 32, the rotation of the push rods 352 will drive the guide disk 32 to rotate, which makes the position bulge 334 of the clutch disk 33, located in the high indented trough 325 of the guide disk 32 originally, to slid down along the guide object 323, all the way to the low indented trough 324 due to the rotation of the guide disk 32. During the process, the end portion of the clutch lever 333 is lodged in the corresponding fitting indents 2221 (shown in FIG. 9), subject to the pressure by the springy body 34, which makes the second internal gear ring 222 to immobilize, and the second planet gear 232, by the teeth clench with the ring, can rotate to transmit the power after its slow-down.

Figure 11:
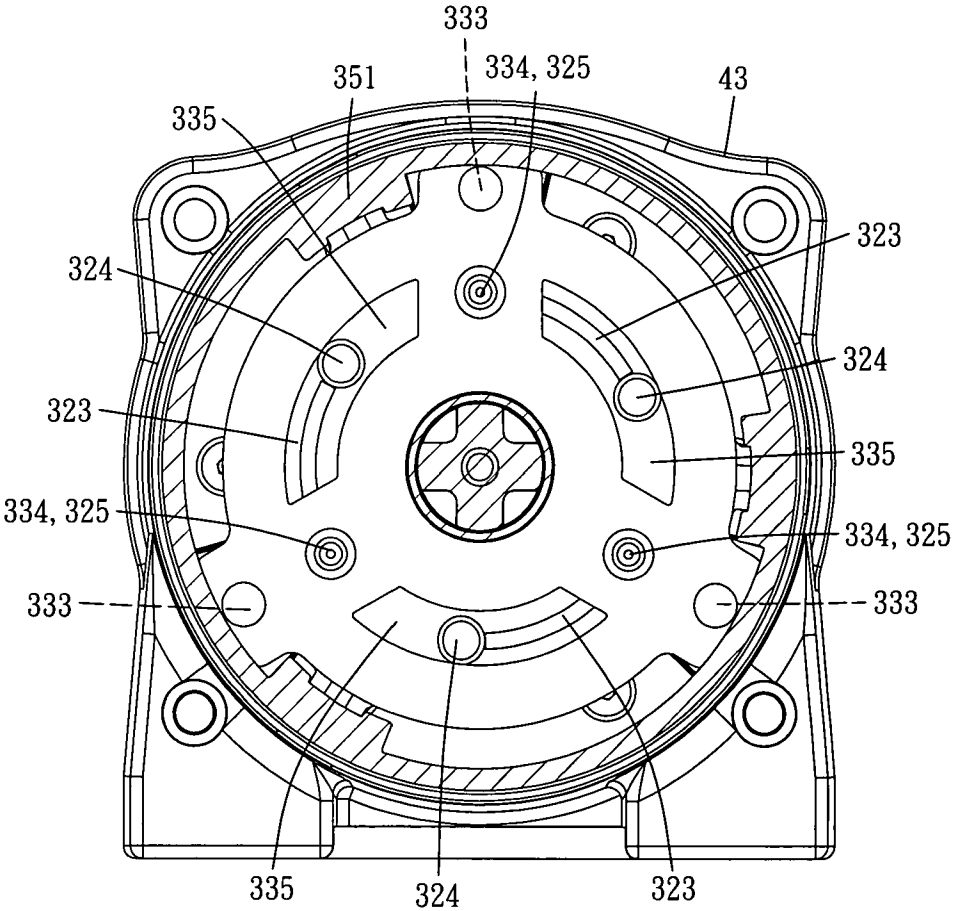
FIG. 11 is a schematic diagram of the function of the clutch disk and guide disk in the "separate" state operated by the exemplified embodiment of the present invention.
Figure 10:
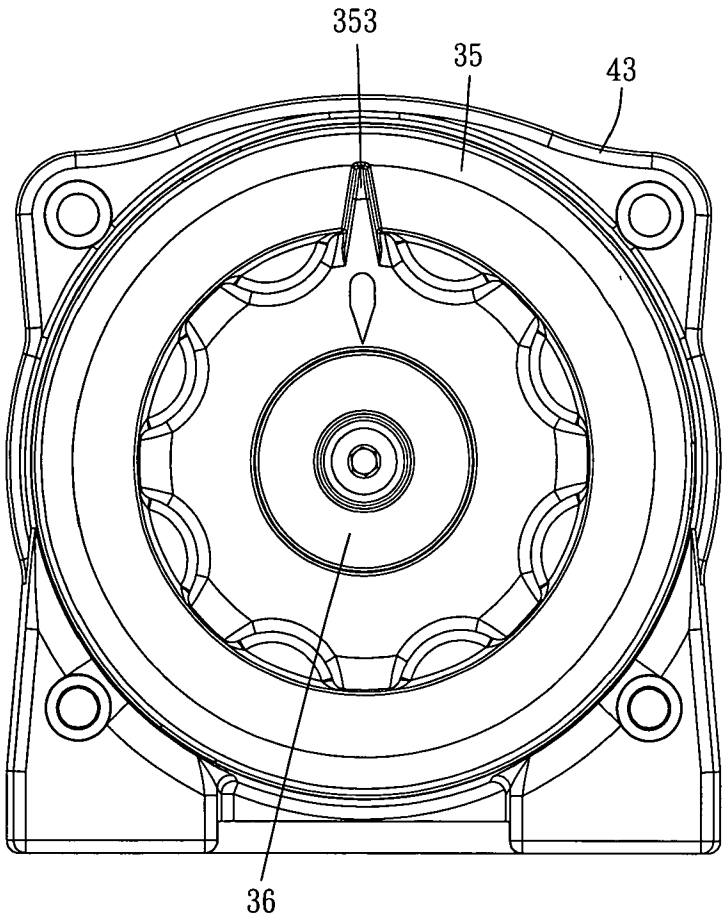
FIG. 10 is a schematic diagram of the indicator of the "separate" state operated by the exemplified embodiment of the present invention.

Referring to FIGS. 10-12, the rotation body 35 is being rotated clockwise (reverse rotation relative to the FIG. 7) according to the direction of FIG. 10, the push rods 352 will drive the guide disk 32 to rotate reversely (shown in FIG. 11), which makes the position bulge 334 of the clutch disk 33, located in the low indented trough 324 of the guide disk 32 originally, slid up along the guide object 323, all the way to the high indented trough 325 due to the rotation of the guide disk 32. During this course, the clutch levers 333 withdraw from the corresponding fitting indents 2221 (shown in FIG. 12) due to the forced resistance to the pressure of the springy body 34, which in turn frees the second internal gear ring 222 to start to rotate, and brings in the immobilization to the second planet gear 232 in a teeth clench with the ring, which makes the power to pause, and the steel rope sheave 40 is free of the control by the power, and the release of steel rope is then accomplished manually.

Accordingly, the winch of the present invention comprises motor, deceleration mechanism, clutch assembly and steel rope sheave, where the clutch assembly further comprises guide disk, clutch disk, springy body, rotation body and fitting disk; through the handling of the rotation body to drive the guide disk for a small angle, the clutch disk can then be pushed to move longitudinally, and the clutch lever is then either to immobilize the second internal gear ring or to release its immobilized state, which further makes the power to arrive or to pause to the steel rope sheave to fulfill the clutch function.

In conclusion, the disclosure of the present invention has not opened to the public for its structure and composition, where the characteristic portions of the structure are not known to the prior art, which is construed to be novel; moreover, the usefulness achieved by the characteristic portions is expected by the objective of the invention and far better than the similar prior art products, which is construed to be useful and creative; An application is now for filing, which deserves your favorable examination and approval.

What is claimed is:

1. A winch clutch assembly, comprising:

a steel rope sheave disposed in a sheave rack;

a motor fixed to a first end portion of the sheave rack, the motor having a drive rod driven by the motor, the drive rod having a drive gear coupled thereto;

a deceleration mechanism having a shell fixed to a second end portion of the sheave rack, the shell having a hollow portion formed therein, the shell together with the second end portion of the sheave rack accommodating a first internal gear ring, a second internal gear ring and a third internal gear ring, the first internal gear ring being formed on an inner wall of the shell, a catch trough disposed adjacent the first internal gear ring for accommodating the second internal gear ring, the second internal gear ring having a plurality of fitting indentations along an outer annular wall thereof facing the first internal gear ring, the third internal gear ring being disposed adjacent the catch trough and having a diameter that is larger than a diameter of the first internal gear ring and the second internal gear ring, a plurality of fitting holes formed in a side portion of the shell and connecting to the catch trough;

a first planet gear meshed with the first internal gear ring, the first planet gear being accommodated in the first internal gear ring, the drive gear of the drive rod being inserted into a center portion of the first planet gear and meshed with the first planet gear, a first planet power gear protruding from the first planet gear;

a second planet gear meshed with the second internal gear ring, the second planet gear being accommodated in the second internal gear ring, the first planet power gear being inserted into a center portion of the second planet gear and meshed with the second planet gear, a second planet power gear protruding from the second planet gear;

a third planet gear meshed with the third internal gear ring, the third planet gear being accommodated in the third internal gear ring, the second planet power gear being inserted into a center portion of the third planet gear and meshed with the third planet gear, a third planet power gear protruding from the third planet gear; and a clutch assembly coupled to the deceleration mechanism and positioned further away from the sheave rack than the deceleration mechanism, the clutch assembly further comprising:

a cover for covering the hollow portion of the shell, the cover having a cover protrusion formed thereon having a through hole formed therein;

a guide disk having a hole formed therein for receiving the cover protrusion, the guide disk having at least one push trough formed therein, a plurality of guide objects being formed on a first side of the guide disk away from the cover, a plurality of push bulges being disposed on the first side of the guide disk;

a clutch disk having a hole formed therein for receiving the cover protrusion, the clutch disk having a plurality of clutch levers and a plurality of position bulges on a side of the clutch disk facing the guide disk, a plurality of arced troughs formed in the clutch disk and corresponding to the guide objects of the guide disk, wherein the clutch levers penetrate the cover and the fitting holes of the shell and are lodged in the fitting indentations of the second internal gear ring, and the position bulges contact the guide objects of the guide disk;

a spring body engaging the cover protrusion at a position adjacent the clutch disk;

a rotation body having a through hole at a center portion thereof, the rotation body having a cover shell for covering and engaging the spring body, a plurality of push rods formed on an inside portion of the cover shell for clamping a corresponding push bulge of the guide disk; and a fitting disk disposed adjacent the through hole of the rotation body and being fastened to the cover protrusion.

2. The winch clutch assembly as in claim 1, wherein the number of the fitting holes of the shell is three.

3. The winch clutch assembly as in claim 1, wherein the number of the push troughs of the guide disk is three.

4. The winch clutch assembly as in claim 1, wherein the number of the guide objects on the guide disk is three.

5. The winch clutch assembly as in claim 4, wherein the push troughs include a plurality of low indented troughs and a plurality of high indented trough, and the guide objects have a lower portion leading to a low indented trough.

6. The winch clutch assembly as in claim 4, wherein the push troughs include a plurality of low indented troughs and a plurality of high indented trough, and the guide objects have a higher portion leading to a high indented trough.

7. The winch clutch assembly as in claim 1, wherein the push troughs include a plurality of low indented troughs and a plurality of high indented trough, and the guide objects have a lower portion leading to a low indented trough.

8. The winch clutch assembly as in claim 1, wherein the push troughs include a plurality of low indented troughs and a plurality of high indented trough, and the guide objects have a higher portion leading to a high indented trough.

9. The winch clutch assembly as in claim 1, wherein the number of the clutch levers of the clutch disk is three.

10. The winch clutch assembly as in claim 1, wherein the number of the position bulges on the clutch disk is three.

11. The winch clutch assembly as in claim 1, wherein the number of the arced troughs on the clutch disk is three, and each arced trough is between two position bulges.

* * * * *